United States Patent [19]

Ackermann

[11] 4,313,099

[45] Jan. 26, 1982

[54] CURRENT LIMITING FUSE HAVING ALUMINUM SULFATE ARC-QUENCHING FILLER

[75] Inventor: John Ackermann, Belleville, Ill.

[73] Assignee: McGraw-Edison Company, Rolling Meadows, Ill.

[21] Appl. No.: 109,238

[22] Filed: Jan. 3, 1980

[51] Int. Cl.[3] ..... H01H 85/18

[52] U.S. Cl. ..... 337/162; 200/149 A; 337/276; 337/280

[58] Field of Search ..... 337/144, 158, 161, 162, 337/276, 279, 280, 282; 200/144 C, 149 A; 361/2, 14

[56] References Cited

U.S. PATENT DOCUMENTS

| | | | |
|---|---|---|---|
| 1,157,919 | 10/1915 | Arsen | 337/280 |
| 1,480,225 | 1/1924 | Snook | 337/280 |
| 1,959,770 | 5/1934 | Slepian | 337/280 |
| 2,199,551 | 5/1940 | Triplett | 337/280 |
| 2,285,602 | 6/1942 | McMahon | 337/280 |
| 2,319,276 | 5/1943 | Triplett | 337/280 |
| 2,496,704 | 2/1950 | Sahnoe | 337/280 |
| 2,502,992 | 4/1950 | Rawlins | 337/280 |
| 2,551,830 | 5/1951 | Dryer | 337/280 |
| 2,676,912 | 3/1954 | Wallace | 337/280 |
| 2,752,458 | 6/1956 | Baker et al. | 337/280 |
| 3,143,615 | 8/1964 | Kozacka | 337/280 |
| 3,166,656 | 1/1965 | Hollmann et al. | 337/276 |
| 3,213,242 | 10/1965 | Cameron | 337/280 |
| 3,222,479 | 12/1965 | Franklin et al. | 337/280 |
| 3,719,912 | 3/1973 | Harner et al. | 337/280 |
| 4,074,220 | 2/1978 | Santilli | 337/276 |
| 4,109,228 | 8/1978 | Wyckendt | 337/276 |
| 4,140,988 | 2/1979 | Oakes | 337/279 |
| 4,158,188 | 6/1979 | Howard | 337/290 |

*Primary Examiner*—William H. Beha, Jr.
*Attorney, Agent, or Firm*—Charles W. MacKinnon; Jon Carl Gealow; Ronald J. LaPorte

[57] ABSTRACT

A current limiting fuse construction including a fuse element extending between electrically conductive terminals carries a body of arc-quenching filler material within a hollow casing of electrical insulating material. The filler material includes a first portion of arc quenching aluminum sulfate mixed with calcium sulfate binder, and second portion of arc quenching silica sand arranged in stratified layers, with the aluminum sulfate layer being positioned closest to a weak spot of the fuse element, and the layer of silica sand being positioned closer to an end cap of the fuse casing.

17 Claims, 2 Drawing Figures

CURRENT LIMITING FUSE HAVING ALUMINUM SULFATE ARC-QUENCHING FILLER

BACKGROUND OF THE INVENTION

This invention pertains to current limiting fuses, and more particularly to such fuses having filler materials containing water that absorb energy during fuse operation by having their chemically bonded water molecules driven off as steam.

Fuses of the kind described can be used to protect various electrical devices so as to limit the amount of current flowing through those devices when a fault occurs. By limiting such overcurrents, the fuses also limit the amount of energy flowing in the electrical circuit in which they are installed. During fuse operation, energy of the electric circuit is absorbed by the fuse to melt one or more portions of fusible elements contained within the fuse. After a first portion of a fusible element is melted, the voltage across the melted portion rises very rapidly, and an arc is formed across the melted portion, subsequently vaporizing both melted and unmelted portions of the fusible element. During this time, a great quantity of heat is generated by the electrical arc. To operate successfully, the current limiting fuse must absorb appreciable amounts of the heat energy generated by the electric arc, to preclude internal carbonization of the fuse and also to preclude the fuse from burning. Filler materials of the type containing water are heated upon contact with an electric arc, converting their contained water to steam, thereby absorbing significant amounts of heat energy. It is crucial then that a fuse filler material of the above-described type retain its moisture content until an arc is initiated. If the water content is not available to absorb heat energy through the above-described phase change, then current continues to flow through the molten metal of the fuse link, and with the attendant rise in arc voltage as described above, the arc continues to heat the melted fusible material until it vaporizes. After the metal has been vaporized, it can still support a flow of current, with the arc occurring in the filler material of the fuse where the molten metal existed previously. The fuse will then continue to absorb energy, and the arc will continue to burn and lengthen, until the path becomes too long for the resulting voltage to sustain the arc. Arcs, inadequately quenched within a fuse have been observed to travel outside the fuse casing, melting the fuse terminals, thereby causing destruction to surrounding equipment.

It has been observed that prior art fuse filler materials of the above-described type lose a substantial portion of their contained water during prolonged low level overcurrent fuse operation. During this time, the fuse has been operated above its current rating, and is heated above its rated temperature. Depending on the design of the fusible element and the amount of overcurrent conducted through the fuse, the fuse filler could be heated for several minutes before the fusible element severs, and an arc is formed within the fuse. During this time, water contained within the fuse filler is driven off as steam, and hence is not available at the time an arc is formed within the fuse.

Further problems are encountered with fuses supplied to the mining industry. Under the Federal Coal Mine Health and Safety Act of 1969, fuses used in mines must be approved by the Bureau of Mines, according to the testing requirements for approval, as reported on page 7564 of the Federal Register, Volume 37, No. 74 dated Saturday, Apr. 15, 1972. In one test, the fuses must be preconditioned (prior to testing) by heating to 90° centigrade for 24 hours. The fuses must then be tested within one hour after removal from the preconditioning chamber.

It has been found that prior art fuse filler materials lose significant portions of their water content during the bake-out or preconditioning process required for testing. One filler material, widely used in the fuse industry, calcium sulfate ($Ca\ S0_4$) loses 67% of its water of hydration after being heated to 90° centigrade for twenty-four hours. Thus, the arc quenching ability of calcium sulfate or its variations commonly known as plaster of paris or gypsum, while generally performing satisfactorily under lower temperature conditions, is significantly degraded when prepared in accordance with the aforementioned testing requirements of the Bureau of Mines. An improved filler material of this type would contain a greater number of water molecules at the time arcing is initiated in the fuse, even after a pretreatment of the above-described type. Also, further energy absorption is possible if the melting temperature of the filler material is low enough to be exceeded during arc formation, such that the filler melts, absorbing from the arc, an amount of energy equal to the material's energy of reaction.

Another problem is encountered in providing fuses to the mining industry and other users who require fuse protection for direct current circuits. Popular filler materials of the type containing water, while satisfactorily interrupting alternating currents do not appear to absorb amounts of direct current arc energy necessary to avoid internal carbonization or burning during fuse operation, particularly fuse operation responding to prolonged low-level overcurrents.

Further, it is desirable to have a single type of fuse which is capable of operating successfully in both direct current and alternating current circuits.

SUMMARY OF THE INVENTION

In general, it is an object of the present invention to provide a current limiting fuse having improved arc quenching and arc limiting characteristics, especially during prolonged, low-level overcurrent operation.

It is another object of the present invention to provide a current limiting fuse of the kind described in which energy is drawn from an electric arc to vaporize water contained in the filler, to thereby cool the arc and assist in current interruption of the electric fuse.

It is another object of the present invention to provide a power fuse which is simple in construction, meets the performance and testing requirements of the Bureau of Mines, and which has a high full load current rating, while being able to operate successfully in both alternating current and direct current circuits.

A dual element fuse is provided with a dielectric casing enclosed at each end by metallic ferrules. Washer-like interior dielectric walls form three interior chambers within the casing. Fusible strips, connected at one end to the metallic ferrules, are supported within the outer chambers. A generally "S"-shaped trigger connector is disposed within the central chamber, and electrically interconnects the fusible strips. Adjacent each interior wall is a layer of homogeneously mixed aluminum sulfate and calcium sulfate which surrounds each fusible strip. A layer of silica sand, surrounding each fusible strip is disposed adjacent the metallic ferrules. The aluminum sulfate provides arc quenching for the fusible strip by absorbing arc heat, converting its contained water into steam. The calcium sulfate mixed with the aluminum sulfate serves as a binder agent imparting increased cohesiveness to the powdered aluminum sulfate material. The mixture of aluminum sulfate and calcium sulfate provides most of the arc quenching of direct currents, while the layer of sand provides most of the arc quenching for alternating currents. The aluminum sulate fuse filler enables fuses employing the filler to comply with Health and Safety Act of 1969, and with the Bureau of Mines testing standards promulgated thereunder.

Under the aforementioned requirements of the Bureau of Mines, fuses must be capable of completely interrupting a direct current within 30 millliseconds after initial current interruption, and must not show any evidence of restriking after 30 milliseconds. Further, the aforementioned performance must be achieved within one hour after preconditioning, during which the fuses are heated to 90° centigrade for 24 hours. Under the aforementioned conditions, prior art for fuse filler materials were found not to perform satisfactorily, i.e. were found to allow the fuse to carbonize internally and therefore restrike, or in more extreme cases, to burn up during testing. By using the aluminum sulfate filler of this invention, a sufficient quantity of water is available in the filler material after preconditioning to absorb heat generated during operation of the fuse such that internal arcing is extinguished, and internal carbonization or burning of the fuse casing is avoided.

These together with additional features, objects and advantages will become apparent from the following, wherein the details of construction and operation are more fully described and claimed. Reference is made to the accompanying drawings forming apart hereof, wherein like numerals refer to like parts throughout.

DETAILED DESCRIPTION OF THE PREFERRED EMBODIMENT

Figure 1:
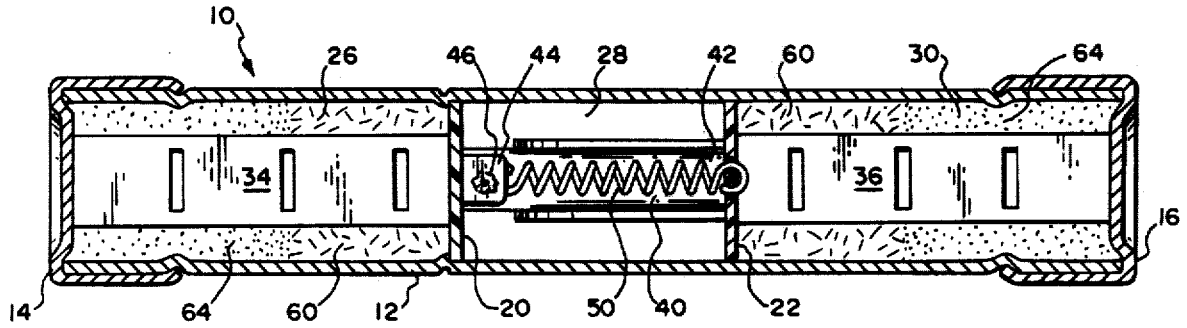
FIG. 1 is a plan sectional view of a current limiting fuse according to the invention.

Referring now to the drawings, a dual element fuse 10 of the type described in U.S. Pat. No. 3,854,111 to Angelo Urani and assigned to the assignee of the present invention, is shown comprising a cylindrical dielectric casing 12, enclosed at each end by metallic ferrules 14, 16. Washerlike interior dielectric walls 20, 22, form three interior chambers 26, 28, and 30. Identical fusible strips 34, 36, are supported within the outer chambers 26, 30 and are joined at first ends by solder or the like to ferrules 14, 16, respectively. A second end of fusible strip 34 is supported by wall 20 through which it passes, 36 is supported by wall 22, through which it passes. Heat absorber 40 is connected at its first end 42 to fusible strip 36, and is supported at its second end 44 by interior wall 20. The second end 44 of heat absorber 40 is electrically connected to fusible strip 34 through a generally S-shaped trigger member 46. The upper and lower ends of trigger member 46 are secured by fusible alloy to fusible strip 34 and heat absorber 40, respectively, as is known in the art. Trigger member 46 is biased for circuit-opening movement by spring 50, which extends between trigger member 46 and interior wall 22.

When conducting a prolonged overload of relatively small magnitude, the fusing alloy securing trigger 46 to fusible strip 34 and heat absorber 40, softens, with trigger 46 moving under the force of spring 50 to break electrical contact between fusible strip 34 and heat absorber, thereby interrupting current flow through the fuse. The aforementioned current interrupting action of trigger 46 provides a time delay operation for overcurrents of relatively small magnitude. With overcurrents of sufficiently larger magnitudes, the fusible strips 34, 36, will melt and sever in a known fashion to interrupt the circuit between ferrules 14, 16, prior to an operation of trigger 46. It is generally desirable to contain any arcing that may occur in chambers 26, 30, when fusible strips 34, 36 sever, and to absorb heat generated by that arcing which would otherwise destroy or electrically contaminate casing 12. According to the invention, chambers 26, 30, are filled with an arc quenching medium comprising stratified layers 60, 64. Numeral 60 is applied to a layer comprising a homogeneous mixture of arc quenching aluminum sulfate and a calcium sulfate binder material, and numeral 64 is applied to a layer of finely divided silica sand. The fuse filler material of this invention may be employed to fill central chamber 28 where arcing is known to occur, but such is not contemplated in the preferred embodiment.

According to the invention, aluminum sulfate in a granular or powdered form surrounds fusible links 34, 36 to provide arc quenching during circuit opening action of those links. The layers of aluminum sulfate contained within casing 12 are bounded at one end by washer-like interior walls 20, 22, and are bounded at their other ends by stratified layers of silica sand 64 disposed adjacent ferrules 14, 16. Interior walls 20, 22, when manufactured within production tolerances, were found to allow a seepage of powdered aluminum sulfate into central chamber 28, during tumble cleaning, handling and shipping of the completed fuse assembly. Also, vapors generated upon the exposure of the aluminum sulfate to an electric arc, were found to seep past metallic ferrules 14, 16, during fuse operation. Upon investigation, it was found that the aluminum sulfate used, a powdered form capable of passing through a 100 mesh screen, could not be contained within chambers 26, 30. The aforementioned problems of the aluminum sulfate filler material leaking past interior walls 20, 22 and the problem of vapor-like arc products leaking past metallic ferrules 14, 16, were eliminated when the aluminum sulfate filler was mixed with calcium sulfate. The calcium sulfate was found to bind the aluminum sulfate together i.e. provide cohesivness for the aluminum sulfate molecules, without degrading the ability of the aluminum sulfate filler to prevent carbonization of the casing 12. The calcium sulfate may be substituted however, by any material that binds the aluminum sulfate together, reducing its undesirable free-flowing characteristics, without deteriorating the fillers resistance to internal electrical tracking.

In the aforementioned mixture of aluminum sulfate filler and calcium sulfate binder materials, the arc quenching properties of the aluminum sulfate were found to greatly exceed the ability of the calcium sulfate to absorb arc energy when tested in accordance with the aforementioned Bureau of Mines standard. For example, in one embodiment of the invention, a dual element fuse of the type shown in FIGS. 1, 2 rated at 60 amperes D. C. comprising a copper strip 0.5 inches wide, 1.25 inches long, and 0.0072 inches thick was inserted in a fuse tube having an internal diameter of 0.75 inches. The innermost portion of the fuse tube was filled with a layer, 0.875 inches thick, of a homogeneous mixture of 60% by weight aluminum sulfate and 40% by weight calcium sulfate. The remainder of the fuse tube was filled with a layer of silica sand 1.156 inches thick. The fuse was then preconditioned by heating to 90° centigrade for 24 hours, and was then tested within 1 hour after removal from the preconditioning apparatus. A direct current of 120 amperes was then passed through the fuse, at a voltage of 600 volts D.C. Each fuse tested was capable of interupting a current within 30 milliseconds after initial current interuption, without showing any evidence of restriking. By way of contrast, another range of tests was made set forth above, but the aluminum sulfate was deleted, the filler comprising 100% calcium sulfate. In such tests, the fuses was found to suffer more than superficial damage and in many cases was burned in half upon the application of the aforementioned test current applied in accordance with the Bureau of Mines Standards, described above.

Although the aforementioned test was performed on an arc quenching medium containing 60% by weight aluminum sulfate and 40% by weight calcium sulfate, the applicant has found that the aluminum sulfate content may range from 100% by weight to 60% by weight, with the corresponding calcium sulfate content ranging from 0% by weight to 40% by weight. Other mixtures may apply, however, when binder materials other than calcium sulfate are provided.

It was found during the aforementioned testing that aluminum sulfate retains 62% of its water content, approximately 83% by weight, after preconditioning, whereas the calcium sulfate retained only 25% of its water content after pre-conditioning. Further, the quantity of water contained in the aluminum sulfate arc quenching material greatly exceeded the quantity of water contained in a calcium sulfate binder material. After pre-conditioning, each mole of aluminum sulfate contains 10 moles of water, whereas each mole of calcium sulfate contains only one half mole of water. Thus, the aluminum sulfate provided more water available for arc energy absorption after pre-conditioning.

Figure 2:
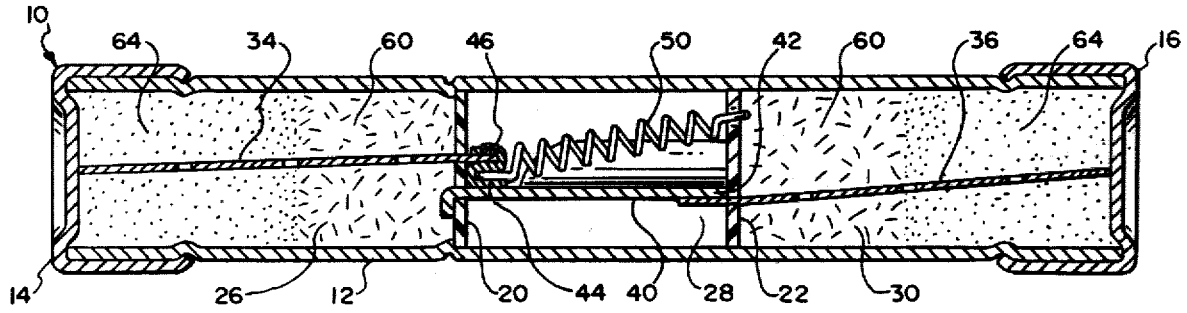
FIG. 2 is a side sectional view of the fuse of FIG. 1.

The aluminum sulfate fuse filler material of this invention has preferred application in direct current circuits. Fuses which operate to interrupt direct currents are more likely to restrike or burn up while clearing an overcurrent, than are similar fuses installed in alternating current circuits. Such malfunction is even more likely if the overcurrents are very small, requiring significantly longer times to initiate circuit clearing. Generally, the aluminum sulfate layer provides improved arc quenching for direct currents, whereas the layer of sand 64 provides arc quenching for alternating currents. By combining layers of aluminum sulfate and sand, a single fuse is provided which can be employed in both direct current and alternating current circuits, thus reducing the risk that there might mistakenly be installed a fuse constructed for direct current applications in an alternating current circuit, and vice versa. According to the invention, aluminum sulfate is positioned to surround that portion of a fusible element which first responds to an overcurrent to melt and thereafter sever, forming an arc. Accordingly, the layers 34, 36 of aluminum sulfate, as shown in FIGS. 1, 2, are located to surround the innermost portions of fusible elements 34, 36. When a fuse of the above-described type is installed in a direct current circuit, the aluminum sulfate filler provides nearly all the arc quenching of the composite layers of aluminum sulfate-calcium sulfate filler and sand. Under alternating current interruption the aluminum sulfate enhances the arc quenching afforded by the layer of sand, but the layer of sand is relied upon to provide the majority of said arc quenching function.

Another battery of tests were performed on fuses of the type described above, utilizing alternating current tests performed in accordance with Underwriters Laboratories standards. In each case, the fuses were found to perform satisfactorily, with the majority of the arc quenching performance attributed to the silica sand layer. Although the ratio of silica sand to aluminum sulfate-calcium sulfate filler was 1.32 for the subject fuse test, applicant has found that satisfactory performance can be achieved with ratios ranging 0.6 and 2.2, over a range of fuses rated between 30 amperes A.C., 30 amperes D.C., and 600 amperes A.C., 600 amperes D.C.

A further advantage is realized by employing aluminum sulfate as a fuse filler, in that its decomposition temperature of approximately 600° C. is well below arc temperatures, normally ranging between 2000° C. and 4000° C. Hence, the aluminum sulfate will, upon exposure to an arc and after its entire water content is converted to steam, absorb an amount of energy equal to the material's energy of reaction.

Thus, it can be seen that applicant has provided an improved fuse filler material which contains a greater amount of water at elevated temperatures than prior art fuse fillers. Also, a single fuse offering improved performance for both A.C. and D.C. circuits has been provided by the above-described invention.

While a preferred embodiment of this invention has been illustrated and described, and will be recognized that the invention may be otherwise variously embodied in practice within the scope of the following claims.

I claim:

1. A current limiting fuse comprising:

a fusible element; and an arc quenching medium surrounding said fusible element, said arc quenching medium comprising aluminum sulfate.

2. The current limiting fuse of claim 1 wherein said arc quenching medium further comprises a homogeneous mixture of aluminum sulfate and a binding agent.

3. The current limiting fuse of claim 2 wherein set arc quenching medium comprises a homogeneous mixture of at least 60% to 100% by weight of ground aluminum sulfate, the balance of said medium being a filler material which binds said aluminum sulfate.

4. The current limiting fuse of claim 2 wherein said binding agent comprises calcium sulfate.

5. The current limiting fuse of claim 4 wherein said arc quenching medium comprises a homogeneous mixture of 60% to 100% by weight of aluminum sulfate and 40% to 0% by weight of calcium sulfate.

6. The current limiting fuse of claim 1 wherein said arc quenching medium comprises stratified layers of aluminum sulfate and sand.

7. The current limiting fuse of claim 6 wherein said aluminum sulfate is homogeneously mixed with a binding agent.

8. The current limiting fuse of claim 7 wherein said arc quenching medium comprises a homogeneous mixture of 60% to 100% by weight of ground aluminum sulfate, 40% to 0% by weight filler material which binds said aluminum sulfate.

9. The current limiting fuse of claim 7 wherein said binding agent comprises calcium sulfate.

10. A current limiting fuse for interrupting an external direct current circuit comprising:

a fusible element having a predetermined peak energy rating; and a predetermined amount of arc quenching medium surrounding said fusible element, said arc quenching medium including a predetermined amount of aluminum sulfate which absorbs heat energy from said fusible element during said interruption of said direct current, such that said fuse completely interrupts said direct current within a period of 30 milliseconds after an initial interuption of said direct current, without restriking after said 30 milliseconds.

11. The current limiting fuse of claim 10 wherein said arc quenching medium further comprises a homogeneous mixture of aluminum sulfate and a binding agent.

12. The current limiting fuse of claim 11 wherein said arc quenching medium comprises a homogeneous mixture of at least 60% to 100% by weight of ground aluminum sulfate, the balance being a filler material which binds said aluminum sulfate.

13. The current limiting fuse of claim 11 wherein said binding agent comprises calcium sulfate.

14. The current limiting fuse of claim 13 wherein said arc quenching medium comprises a homogeneous mixture of 60% to 100% by weight of aluminum sulfate, and 40% to 0% by weight of calcium sulfate.

15. The current limiting fuse of claim 10 wherein said arc quenching medium retains at least 62% water on a permole basis after being maintained at 90 degrees centigrade for 24 hours.

16. The current limiting fuse of claim 10 wherein said arc quenching medium further comprises stratified layers of aluminum sulfate and sand, whereby said fuse is capable of interrupting an alternating current as well as direct current.

17. A current limiting fuse comprising;

a fusible element having at least one weak spot formed therein;

an arc quenching medium including aluminum sulfate surrounding said weak spot of said fusible element;

a stratified layer of sand surrounding said fusible element, adjacent said arc quenching medium.

* * * * *